United States Patent [19]

White

[11] Patent Number: 4,925,144

[45] Date of Patent: May 15, 1990

[54] PORTABLE BOOKHOLDER

[76] Inventor: Dennis E. White, 1916 - 23rd Ave., San Francisco, Calif. 94116-1213

[21] Appl. No.: 126,245

[22] Filed: Nov. 27, 1987

[51] Int. Cl.[5] ..... A47B 23/00

[52] U.S. Cl. ..... 248/445; 248/446

[58] Field of Search ..... 248/445, 447.2, 448, 248/458, 106, 446, 447.1, 451; 281/45, 49, 42, 41

[56] References Cited

U.S. PATENT DOCUMENTS

| | | | |
|---|---|---|---|
| 2,470,694 | 5/1949 | Foo | 248/106 |
| 2,638,701 | 5/1953 | Dahlgren | 248/445 |
| 2,896,364 | 7/1959 | McCollister | 248/445 |
| 2,908,465 | 10/1959 | Lykes | 248/445 X |
| 3,514,066 | 5/1970 | Singleton et al. | 248/445 |
| 3,740,015 | 6/1973 | Adams | 248/445 |
| 3,889,914 | 6/1975 | Torme | 248/445 |
| 4,140,296 | 2/1979 | Guzman Guillien | 248/445 |
| 4,431,156 | 2/1984 | Mena | 248/445 |
| 4,465,255 | 8/1984 | Hill | 248/445 |
| 4,496,126 | 1/1985 | Melton et al. | 248/445 X |
| 4,512,603 | 4/1985 | Williams | 248/451 X |

*Primary Examiner*—Ramon O. Ramirez

*Attorney, Agent, or Firm*—Berthold J. Weis

[57] ABSTRACT

A bookholder is described, relying on a single unitary or articulated main member to support a book in contact with one end thereof, with the aid of crossbars and/or clamps mating therewith.

28 Claims, 7 Drawing Sheets

PORTABLE BOOKHOLDER

BACKGROUND OF THE INVENTION

The present invention relates to bookholders, and more particularly to bookholders which will support reading materials for reading in a reclined position.

Reading printed materials is one of the most important avenues of acquiring information and most of us spend hours on this activity. While not considered to be physiologically hard work, reading can be surprisingly physically tiring, particularly when in a fully or partially reclined position. This is so because the reader is required to extend his arm above the elevation of the heart in order to keep the book in the proper relationship to his eyes. Fatigue sets in relatively quickly.

Others have recognized the need for bookholders to support reading materials for reading in bed, not only for the infirm or bedridden, but also for healthy people to permit comfortable reading for extended time periods, as shown in the following patents.

U.S. Pat. Nos. 2,780,027; 2,828,577; 3,740,015, 4,431,156; and Dutch Patent No. 83333; show devices comprising generally book supporting frameworks resting on the bed or secured to the frame or headboard. These frameworks support various holders for engaging the pages of the book or supporting the book on a transparent base. The disadvantage which these devices have in common is that they are relatively confining, since they comprise support members extending bilaterally in close proximity to the reader's body. U.S. Pat. Nos. 3,514,066 and 4,465,255 show bookholders having support members extending only on one side, providing some improvement in the sense that the reader has freedom of movement, at least to one side. However, all these devices are essentially restricted to use in bed, and are difficult to move and store since they are relatively complicated and bulky, even in a folded state.

OBJECTS OF THE INVENTION

A major object of the present invention is to provide a bookholder for supporting reading material which is simple, lightweight and versatile, in the sense that it can be attached to a variety of home furnishings and other supporting environments, and can be readily moved and emplaced.

Another object of the invention is to provide a bookholder which can be folded into a small package to permit easy storage and portability.

An important object of the invention is to provide a bookholder which can be used not only in bed, but also on the beach by sunbathers.

Another object of the invention is to provide a bookholder which is capable of being folded to permit a reader to use it lying prone, or sitting on a lawn chair or at a desk.

These and other objects of the invention will become apparent upon consideration of the description, drawings and claims.

SUMMARY OF THE INVENTION

The present invention is a support for reading materials, principally books, which is readily portable and can be used in a wide variety of environments, including at the beach. The support comprises a single main member, a first end of which is adapted to securely engage the reader's environment, and the other having an inverted v shape generally complementary to the cross-section of a partially open book for holding reading material in viewing position. The main member may be wood, plastic or stainless steel of sufficient strength to stably support books weighing several pounds and preferably has a cross-section of high width to thickness ratio. In order to make the book support more universally useful, such as for reading at home in bed, clamps and joints are provided which make it possible to secure the support to furniture and the like. It is particularly intended to provide a book support capable of being used by sunbathers at the beach, for which purpose the first end is made long enough to be partially buried in sand to the side of the reader and support reading material in a viewing position. To facilitate transport and storage the main support member may be articulated such as to allow the book support to be collapsed into a compact package. The reading matter is firmly and stably held by cross-arms, straps and clamps, individually or together cooperating with the inverted v-shaped end of the support.

BRIEF DESCRIPTION OF THE DRAWINGS

With reference to the drawings, FIG. 1 shows a support for reading matter 11 emplaced in sand 12, illustrating this use of the support at the beach, one of the principal uses for which the present invention is intended to serve. The support 11, comprises a single unitary elongated support member 13, made of wood, laminated wood, plastic, or metal such as stainless steel or aluminum. One end 14 is shown to be buried in sand to a depth sufficient to hold the book firmly. To facilitate emplacement, end 14 may be tapered. To enhance stability end 14 may also be made wider than the exposed part of member 13.

Figure 1:
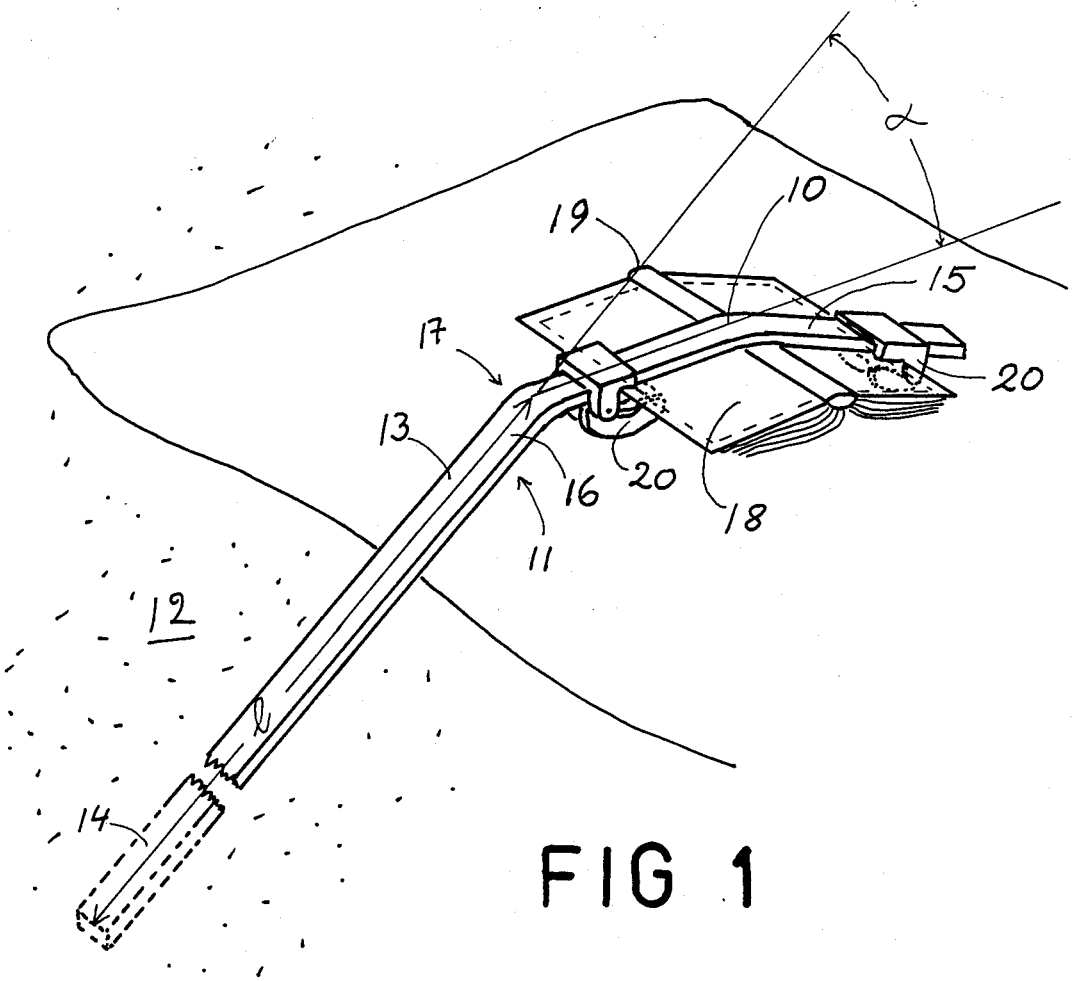
FIG. 1 a perspective view of the present bookholder as used at the beach.

The other end. 15, extends from the central section 16 at an angle determined by bend 17. The preferred shape of end 15 adjacent to the reading matter is in the form of a shallow inverted v, with a bend or apex 10 of about 145–170° or about 150°, which makes it significantly easier to hold reading matter in place, because the book 18 or other reading matter being forced into a slightly folded condition helps to self-support it in the center 19. This permits books and the like to be held in place by means of clamps 20 alone, as described in greater detail below. The length λ of end 14 and bend 17, and the angle $\alpha$ of bend 17, are chosen to place the reading matter at the proper distance from the reader's eyes. Representative values of $\lambda$ and $\alpha$ of 36–48 inches or about 40 inches and 15°–30° respectively, will bring the reading matter into the correct position when placed in sand at about 45° and to a depth of about 10–18 or about 12 inches. It will be apparent that the present invention is easy to use while minimally obstructing the reader's freedom of movement.

FIGS. *2a* and *2b* illustrate preferred embodiments capable of being folded into a compact form, which is easy to carry and store. The means for securing the reading matter to the support are omitted from this drawing and are discussed in greater detail below. Support member 21 is articulated in four places by means of hinged joints 22 so that the main member may be folded into a configuration generally complementary to reading material bearing end 23. Abutments 24 limit further rotation about the joint when the bookholder is in an open condition. While the configuration of the folded bookholder, articulated in four places, but not at the apex 10, as shown in the drawing is preferred, it should be understood that a foldable bookholder could be made by providing articulating joints at more or fewer places, including the apex.

As shown in FIG. *2b*, the support member 21 may be partially telescoping, in order to allow it to be collapsed into a more compact form. Again, it is possible to employ a combination of telescoping and articulating features to permit reducing the size.

FIGS. *3a*, *3b* and *3c* show alternative joint constructions in further detail. FIG. *3a* shows, in perspective, the open hinge 31 whose travel is limited by abutments 32. The same figure also indicates the preferred ribbed construction 36 when the book support is made of plastic in order to save material without sacrificing strength. FIG. *3b* shows a hinge configuration capable of being clamped into an arbitrary angular position by means of wing nut 33, or equivalent device for applying pressure across the joint to arrest rotation by friction. FIG. *3c* shows an exemplary ball joint 35 which permits more universal adjustment in order to permit the support to be used in a wider variety of settings, such as at home. The preferred placement of the ball or equivalent universal joint is between the bottom end 14 and the central portion 16 of the main member 11. Tightening nut 37 compresses fingers 38 against the surface of ball 39 to lock the joint in place at the desired angle between bottom and central portions 14 and 16 of the main member 11. Provision of this joint facilitates placing the bottom end under a mattress, between mattress and bed frame, or between or under seat cushions, for example. It also allows the bottom end to be folded to provide a base for the bookholder to stand or rest on independently.

As discussed above, the inverted v-shape of the upper end of the support makes it possible to support reading matter, especially sufficiently stiff books such as hardcover books, with only two clamps. FIGS. *4a* and *4b* show preferred clamps of bent sheetmetal and/or plastic in detail. Clamp 41 comprises a first part 42, which defines a slot or recess 43 which snugly engages main member 44, permitting the clamp to slide back and forth into position to grip the edge of the reading matter. The jaw part 46 is pivotably joined to part 42, to engage the book by spring 47. Since it is desirable to provide a spring with sufficient force to hold heavy books, jaw part 46 also defines projection 48 to provide the necessary leverage to allow easy opening of the clamp, as shown in FIG. *4a*.

As mentioned, reading material which is relatively stiff can be effectively held in place by clamps alone. However, to accommodate flimsier materials, the reading matter support may include crossbars and straps, which are illustrated in FIGS. *5a*, *5b* and *5c*.

FIG. *5a* shows a crossbar variation which slidably engages main member 50. Crossbar 51 comprises plates 52, preferably made of metal, which are joined at opposite corners 53a and 53b to define space 54 accommodating main member 50. Optional pin 55 protrudes into a slotted recess 56 in the surface of main member 50. This arrangement permits crossbar 51 to be moving in and out in the direction of arrow 57. The elongated recess 56 also permits adjustment of the position of the deployed crossbar in the direction of arrow 58 in order to be able to accommodate reading matter of different sizes. Optionally, the crossbar also includes slidable u-shaped metal members 59, providing means of attachment for straps 60. These straps can be used to attach reading matter to the support, for example by means of Velcro tab fasteners 64.

FIGS. *5b* and *5c* show a preferred variation of crossbar 51, comprising permanent magnet 61, adhesively secured to the crossbar within recess 62. Main member 50 also bears a permanent magnet bar 63, adhesively secured thereto. The function of the magnets is to hold the crossbar to main member 50 with a sufficient force to hold a book. Since the force of the magnet is normal to the mating surfaces, their lateral motion is restrained by recessing one of the magnets deeper, so that the magnets do not meet in the same plane as the surfaces of the crossbar and main member. To engage the reading matter, straps are secured to the crossbar, which can be fastened together by means of Velcro tabs 64 or the like. Crossbars may generally be deployed above or below the main member.

FIG. *6a* illustrates the use of the present reading matter support for holding an exemplary book, using crossbars 51 and associated Velcro straps 60 to support the book by gathering the bulk of the pages 65 as shown, with those relatively fewer pages 66, with which the reader is presently concerned, being held by smaller metal clips 67, which are also provided with the book support kit, and which is separately shown in FIG. *6b* as having relatively long and slender jaws 68 urged together by spring 69.

FIGS. *7a*, *7b* and *7c* show a preferred arrangement of adjustably securing clamps and crossbars to the main member, particularly suited to be made in plastic, with no movable parts. Main member 71, in order to accommodate fastener 72, is slotted along a length on either side of the apex of the book supporting end of the main member. Central rail or protrusion 73 projects interiorly along the entire slot. FIG. *7a* shows the keyed fastener in perspective to show recess 74 between upper and lower shoulder portions 75, which are configured such that the narrow dimension e fits through the width of the slot w, and when the fastener is rotated in place. Shoulder portions 75, preferably slightly beveled along edges 76, snugly engage rail 73. By providing a tight fit, the fastener will not only hold the clamp or crossbar attached to it firmly in place, but will also hold the main member parts on either side of the slot together to prevent spreading. It is obvious that the key configuration could be reversed. Projection 73 could be replaced by a recess, complemented by a keyed fastener having a central mating projection.

Figure 8A:
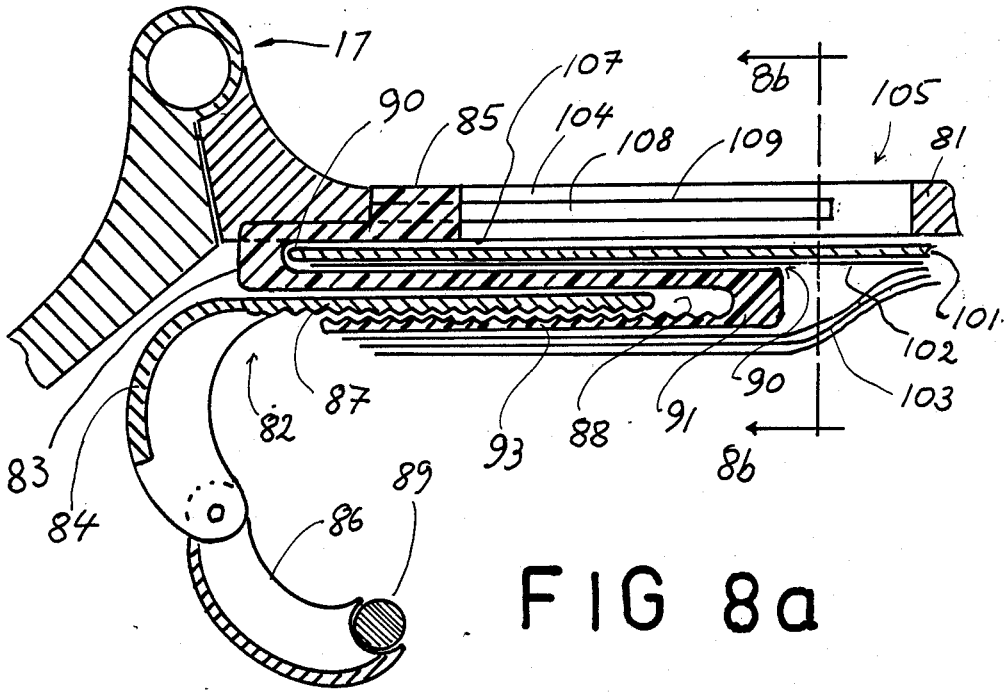
FIGS. 8*a*, 8*b*, 8*c* and 8*d* show another preferred clamp modification which permits movement between the contact point of the jaws holding the pages of the book in place without moving the clamp base with respect to the main member, and preferred clamp tips.
Figure 8B:
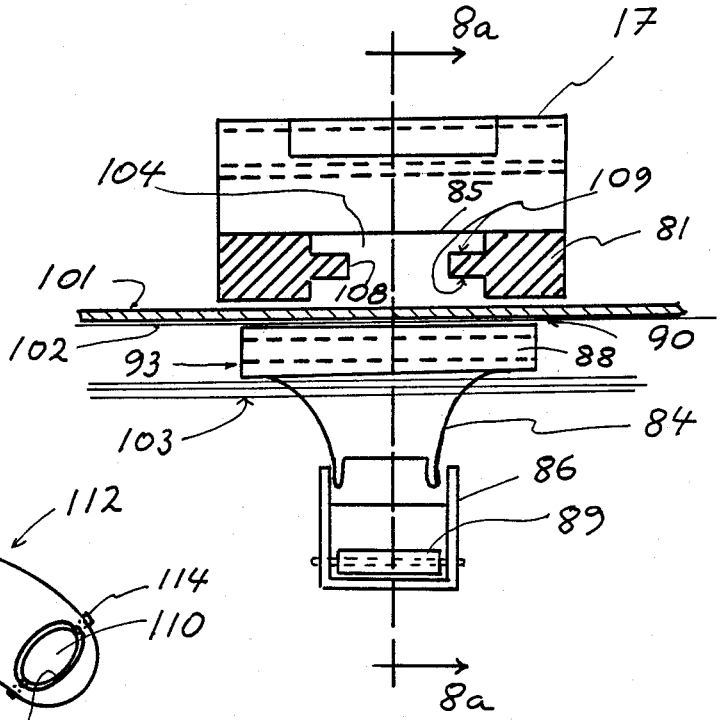

FIGS. 8*a* and 8*b* show a preferred clamp, which is particularly useful for holding books without the aid of crossbars. The salient feature of clamp 82 is that it is comprised of two parts 83 and 84, respectively. Part 83 fastens to the main member 81, as here shown by means of keyed fastener 85 discussed further below. The second part 84 bears the clamp parts with its book engaging jaw 86. Parts 83 and 84 are movable with respect to each other, in that tongue 87 may be moved in and out of elongated recessed slot 88 as needed to position roller 89 to contact an open page at the margin between the edge of the page and the print thereon. This feature is important because the location of the margin changes as the book is opened to show the first or the last pages therein, when part 83 is held in the same position with respect to main member 81. Part 83 in turn is configured to provide a recess 90 between the main member and the portion 91 defining recessed slot 88. Recess 90 is intended to confine the outer cover 101 of a book and an optional number of pages 102. The projecting portion 91 in turn fits between the cover of the book and the remainder of its printed pages 103.

The clamp is deployed by inserting the keyed fastener 85 into slot 104 in main member 81 through opening 105, whose cross-sectional area is large enough to permit passage of the keyed fastener therethrough. The clamp is then moved a desired distance toward the articulated bend 17 so as to be in the proper position to engage one side of the book's cover. In FIG. 8*a* the clamp is shown positioned at the extreme end of the slot 104. Also, the clamp shown exhibits a cover-receiving recess 90 extending beyond fastener 85 toward bend 17. The other side of the book is then engaged by sliding a second clamp into place in the slot on the other side of the apex in the main member, so as to press the center binding upwardly toward the apex of member 81.

It will be appreciated that part 83 of clamp 82 could be fastened to the main member 81 by means of the keyed fasteners shown in FIGS. *7a, 7b* and *7c*. However, the clamp 82 shown in FIGS. 8*a* and 8*b* is considered an improvement in that the fact that portion 106 of the clamp part 85 being recessed into slot 104 provides a flush surface 107 which complements the outer cover 101 of the book. Secondly, it permits slot 90 to extend beyond fastener 85, maximizing the size of a book capable of being supported by a bookholder of a given size. Fastener 85 and rail 108 are configured such that the clamp will slide along the rail when pushed or pulled by hand in order to properly position the clamp, but, when subjected to the weight of the book, the clamp will lock into place by frictional forces generated by the torque which the book exerts on the clamp. In order to enhance the frictional forces which resist movement of the clamp, mating surfaces 109 can be roughened, for example, or otherwise modified to that effect. The entire assembly of book, cover, pages, main member, and parts 83 and 84 of the clamp, is held firmly in place when jaw 86 is closed on the pages. Movement of parts 83 and 84 with respect to each other is also impeded by the increased friction producing irregular surfaces 93 of the mating clamp parts 83 and 84.

Figure 8C:
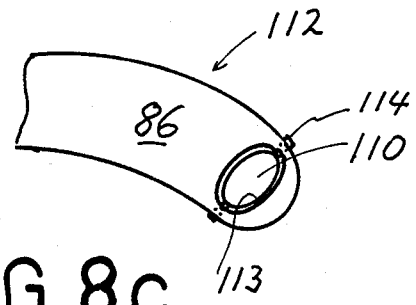
Figure 8D:
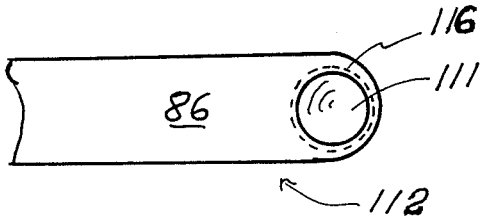

The numeral 89 refers to a cylindrical roller inserted into the tip of the jaw 86, in order to ease turning pages without releasing the clamp. Such rollers are capable of being used with all clamps shown herein. FIGS. 8*c* and 8*d* show preferred rollers 110 and 111 respectively, which may be used at the tips 112 of clamps for engaging and holding the pages of opened books in place. The drawings show a view of the bottom side of a clamp tip which contacts the pages. In general, these rollers are configured so as to hold pages of books in place while reading, but to readily release pages when desired to be turned. In particular, the rollers shown will permit pages to be pulled inwardly and up or down at an angle with respect to the main member. The rollers facilitate ease of turning pages with one hand only, in that they rotate about axes which are at an angle, say 45°, with respect to the outside edge of the pages of the book. FIG. 8*c* shows the roller 110 to be an ellipsoidal body, rotatably secured in a recess 113 of complementary shape in tip 112 by means of pins 114. The recess 113 itself has a depth somewhat greater than one half of the minor diameter of the ellipsoidal roller. In order to properly orient the axis about which the ellipsoidal roller 110 rotates, the jaw 86 of the clamp 82 is correspondingly curved in a plane parallel to the pages of the book.

FIG. 8*d* shows an alternative modification utilizing ball 111, which offers universal rotatability. It is held in a slightly larger than hemispherical recess 116 in the tip 112 of a clamp jaw 86, which is not curved in the plane of the pages of the book.

The roller shown in FIG. 8*d* and the jaw is especially suitable to be made in plastic. The recess 116 is made slightly larger than hemispherical. The degree to which is is larger than the part of the ball recessed within it is determined by (1) the clearance between the jaw recess surfaces and the ball to permit movement of the ball, and (2) the degree to which the plastic can be deformed for ready removal of the jaw from the mold and by ready insertion of the ball into the recess by press-fitting. The same or similar considerations apply to the rollers shown in FIGS. 4*b*, 8*a*, 8*b* and 8*c*.

Figure 2A:
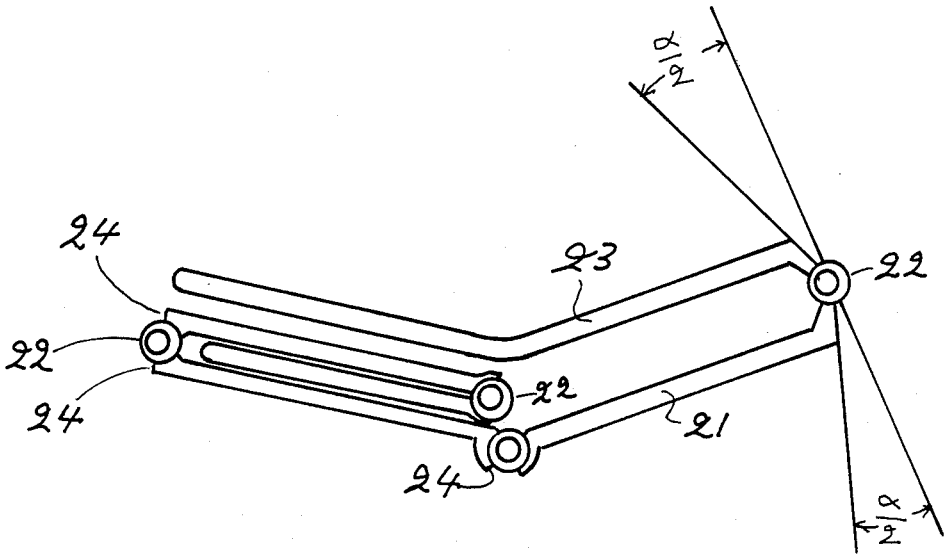
FIG. 2*a* the book support in a folded condition and FIG. 2*b* illustrates a telescoping main member.
Figure 2B:
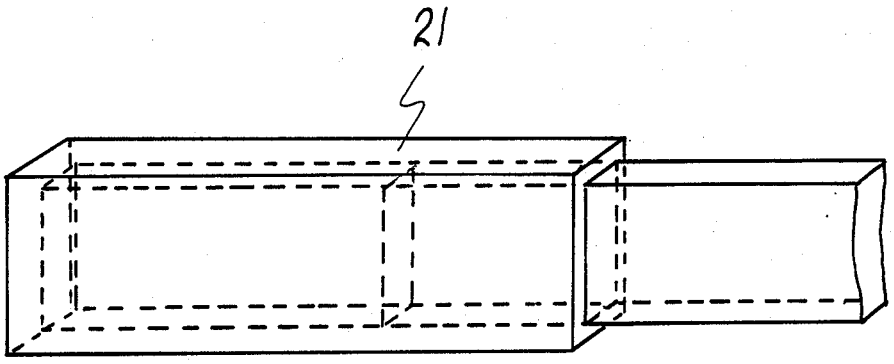
Figure 3A:
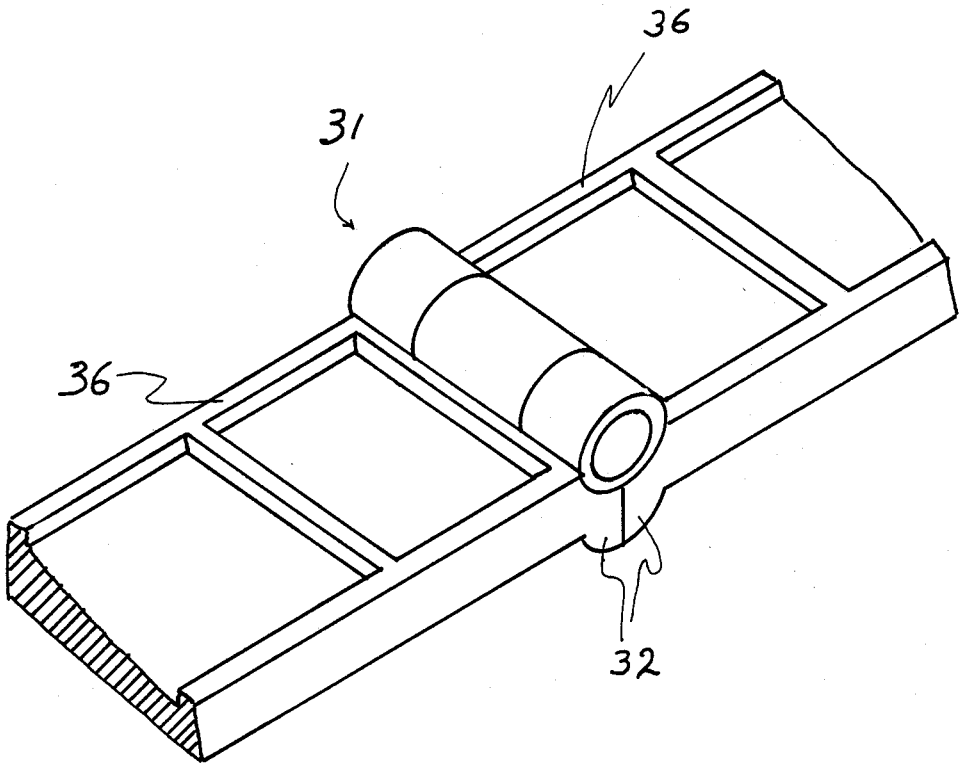
FIGS. 3*a*, 3*b* and 3*c* show alternative constructions of the hinged joints.
Figure 3B:
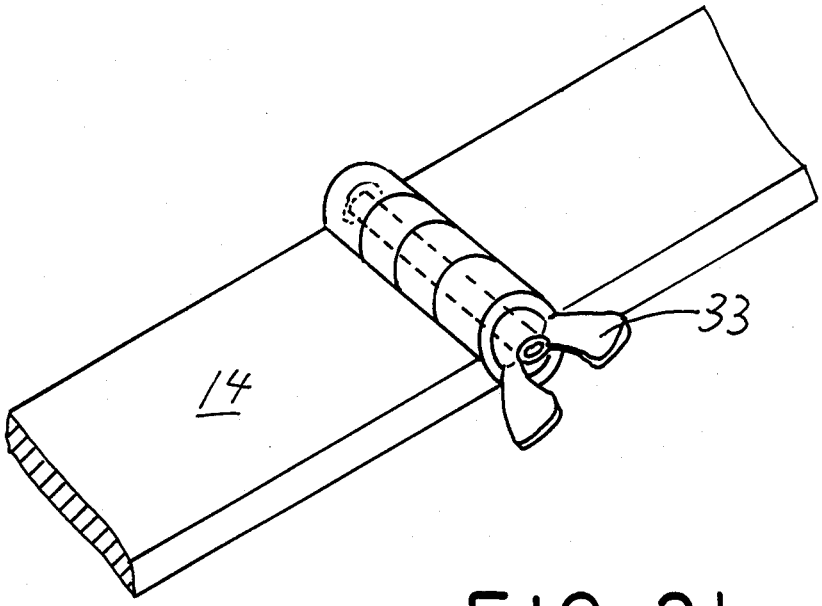
Figure 3C:
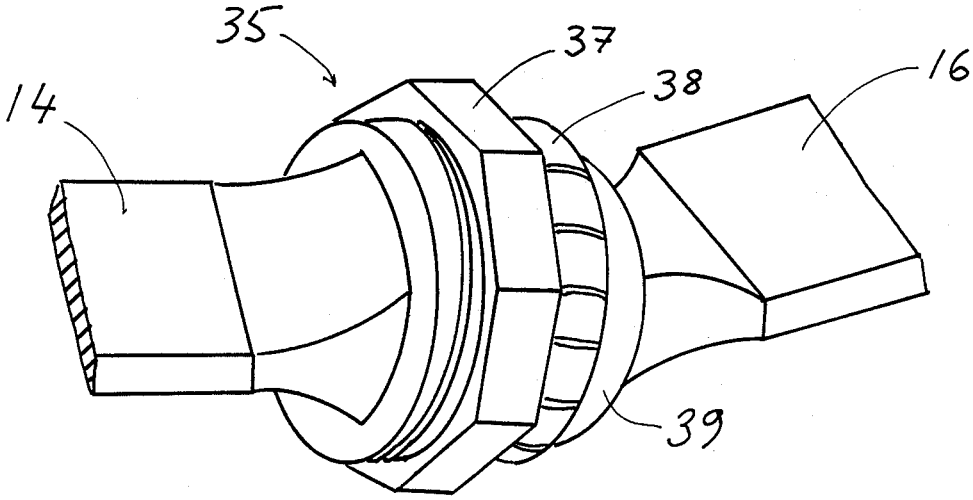
Figure 4:
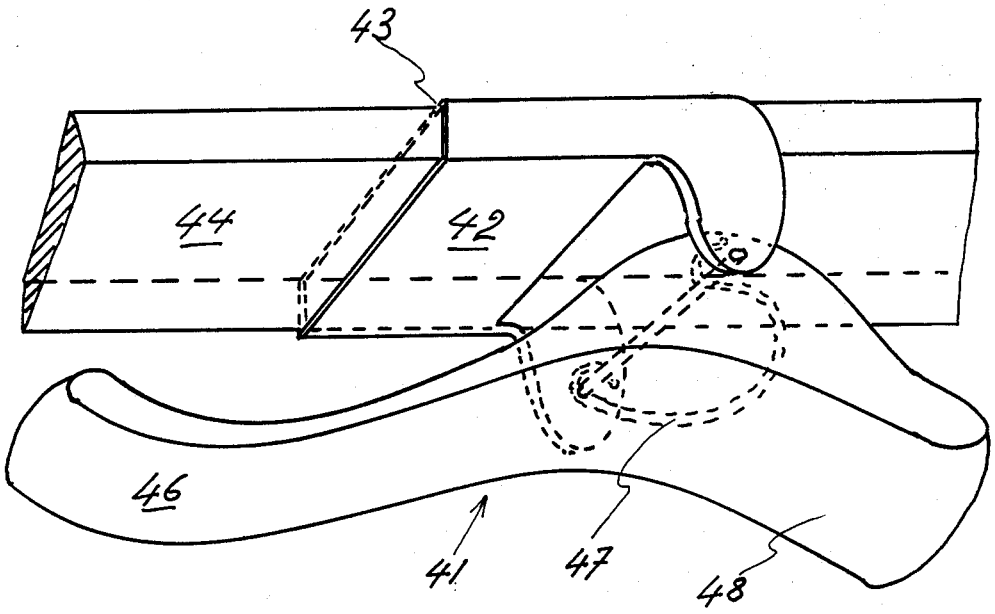
FIG. 4*a* shows an exemplary clamp for holding a book, which can be manufactured from sheet metal and/or plastic.
Figure 5A:
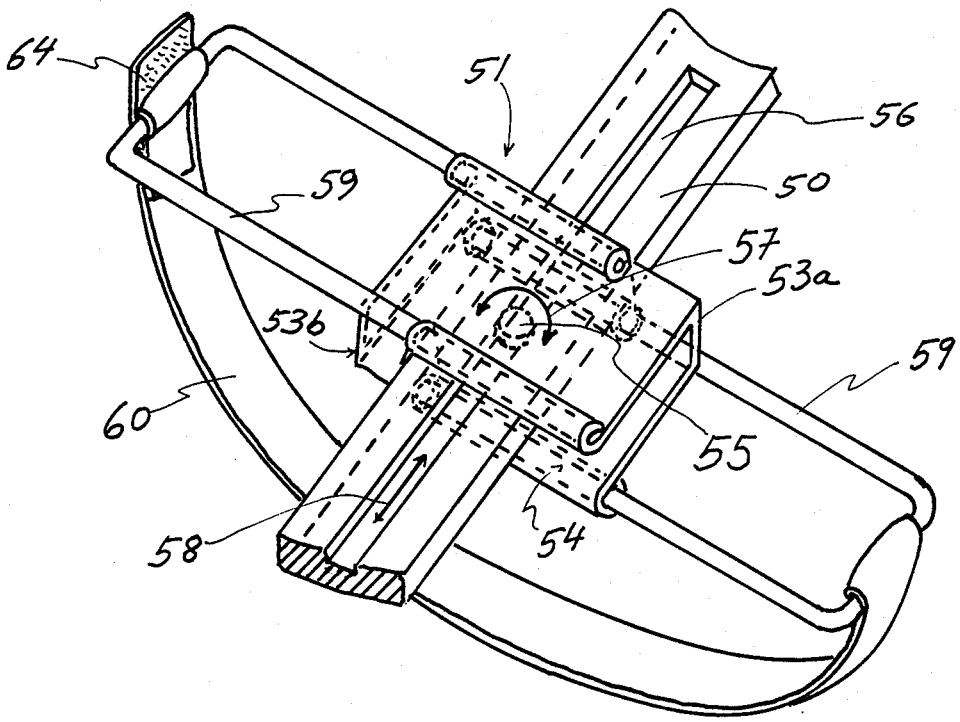
FIGS. 5*a*, 5*b* and 5*c* show various crossbar arrangements in various cross-sections.
Figure 5B:
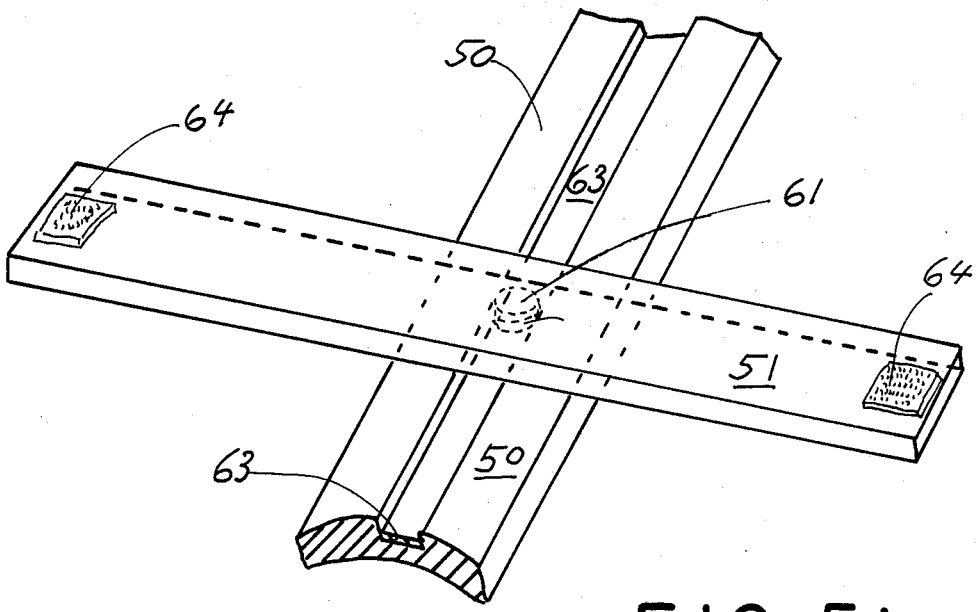
Figure 5C:
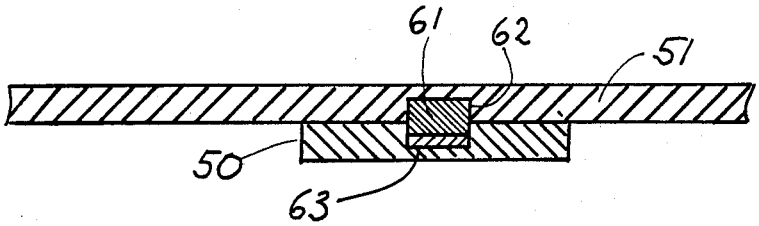
Figure 6A:
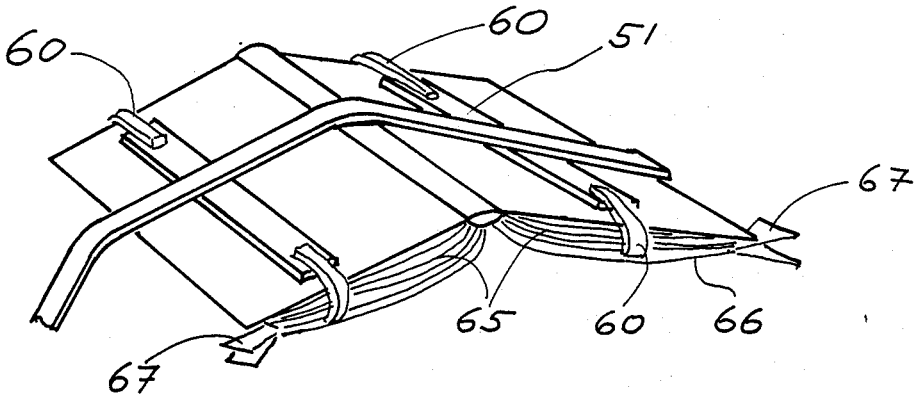
FIGS. 6*a* and 6*b* show a perspective view of the top portion of the bookholder, showing the arrangement of crossbars and straps, and page holder clip.
Figure 6B:
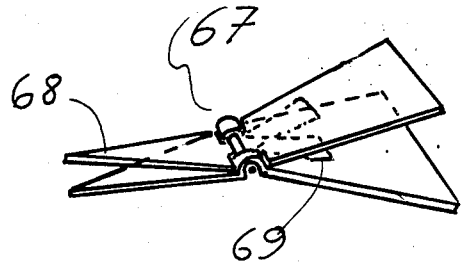
Figure 7A:
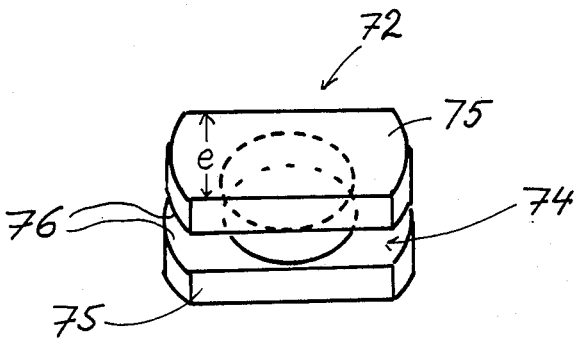
FIGS. 7*a*, 7*b* and 7*c* show in cross-section and perspective, preferred means for fastening clamps and crossbars to a slotted main bookholder member.
Figure 7B:
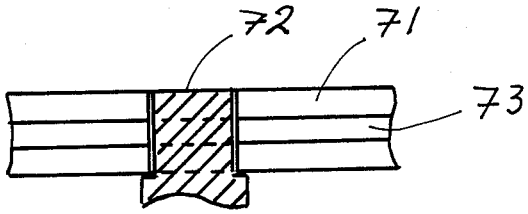
Figure 7C:
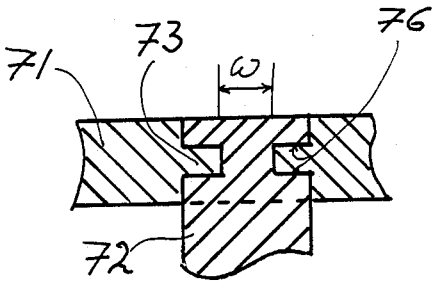

Having thus described the invention, it will be appreciated that modifications may be made without departing from the spirit of the present invention, i.e., that the invention may be made available in the form of a portable kit, with the various components to be made available in the form of a portable kit, where the various component parts of crossbars and clamps are supplied in a package and positioned within the open spaces defined by the folded configuration of a main member such as shown in FIG. 2, and that the scope thereof should be limited solely by the following claims.

I claim:

1. A support for suspending reading matter in the field of view of a reclining reader, comprising:

a single, elongated support member, having a rectangular cross-section of high width to thickness ratio;

said support member having a first end portion capable of securely engaging the reader's environment;

said support member having a second, opposite end extending from said support member, whose longitudinal cross-section is in a shape resembling a shallow, inverted v defining an apex, said shape being generally complementary to the shape of a less than fully open book; and means for securely and releasably forcing and holding said reading matter in a slightly folded, less than fully open condition against the surface of said inverted v shape facing said person and centered about said apex, whereby said reading matter is held in a viewable relationship to said reader.

2. The support of claim 1, further defined in that said member is articulated to define two arms, one of which defining said end having said shape generally complementary to the cross-section of an open book, and the other defining said end for engaging said environment, and a central section, said arms being movably joined to the ends of said central section to permit folding said support into a compact form.

3. The support of claim 2, further defined in that said central section is further articulated into two or more subsections to permit folding the support into still smaller form.

4. The support of claim 2, further defined in that said arms are hingedly joined by means of hinges of limited angular travel between fully open and folded states.

5. The support of claim 2 further defined in that said arms are hingedly joined by means of hinges whose travel is capable of being limited by locking means.

6. The support of claim 2, further defined in that at least one of said arms is joined to said central section with a universally movable joint.

7. The support of claim 1, further defined in that said member is made of wood.

8. The support of claim 1, further defined in that said member is made of laminated wood.

9. The support of claim 1, further defined in that said member is made of plastic.

10. The support of claim 1, further defined in that said member is made of stainless steel.

11. The support of claim 1, further defined in that said first end has a tapered thickness to facilitate being stuck in sand.

12. The support of claim 1, further defined in that said first end is widened to enhance its ability to stick in sand.

13. The support of claim 1, further defined in that it includes means for clamping said first end to furniture and the like.

14. The support of claim 1, further defined in that said means for holding said reading matter comprise clamps, slidably disposed on said second end, for laterally clamping said reading matter to said second end of said member.

15. The support of claim 14, further defined in that said clamps comprise jaws for engaging said reading matter and roller means for contacting said reading material disposed at the ends of said jaws.

16. The support of claim 15, further defined in that said roller means rotate about an axis at an angle to the edge of the page of the reading matter.

17. The support of claim 14, further defined in that said clamps comprise two parts capable of being adjustably moved with respect to each other, a first part engaging said main member, the other part bearing said clamping means for holding down said pages.

18. The support of claim 17 where said clamps define recesses for engaging the edges of book covers.

19. The support of claim 16, wherein said roller means is ellipsoidal.

20. The support of claim 16, wherein said roller means is spherical.

21. A support for suspending reading matter in the field of view of a reclining reader, comprising;

a single elongated member having a rectangular cross-section of high width to thickness ratio;

said member having a first end thereof capable of securely engaging the reader's environment;

said member having a second end with a longitudinal cross-section resembling a shallow, inverted v shape defining an apex, and means for securely and releasably holding said reading matter in a viewable relationship to said reader, which comprise crossbars capable of extending laterally away from said second end of said member, where said crossbars engage said second end of said member rotatably and slidably.

22. The support of claim 21 further defined in that they engage said second end magnetically.

23. The support of claim 21 further defined in that said means for holding said reading matter comprises straps.

24. The support of claim 21, further defined in that said means for holding said reading matter comprises straps and clips in combination, said straps being intended to support the bulk of the weight of the reading matter and said clips fastening selected pages.

25. The support of claim 21, further defined in that said straps comprise Velcro fasteners.

26. The support of claim 23, further defined in that said straps and said crossbars are capable of being deployed cooperatively.

27. The support of claim 21, wherein said second end is slotted along a length on either side of said apex, defining an interiorly projecting protrusion, and wherein said cross-bar comprises a keyed fastener having a narrow first dimension which fits through said slotted second end and a keyed second dimension snugly engaging said protrusion.

28. The support of claim 21, further defined in that said crossbars are removable.

* * * * *